US005437152A

United States Patent [19]

Pfefferle

[11] Patent Number: 5,437,152

[45] Date of Patent: Aug. 1, 1995

[54] CATALYTIC METHOD

[76] Inventor: William C. Pfefferle, 51 Woodland Dr., Middletown, N.J. 07748

[21] Appl. No.: 197,890

[22] Filed: Feb. 17, 1994

Related U.S. Application Data

[63] Continuation-in-part of Ser. No. 22,767, Feb. 25, 1993, abandoned, which is a continuation of Ser. No. 639,012, Jan. 9, 1991, abandoned.

[51] Int. Cl.[6] ..... F01N 3/20

[52] U.S. Cl. ..... 60/274; 60/299; 60/302

[58] Field of Search ..... 60/299, 302, 274; 422/171; 181/240, 272, 281

[56] References Cited

U.S. PATENT DOCUMENTS

| | | | |
|---|---|---|---|
| 1,793,813 | 2/1931 | MacKinnon | 60/302 |
| 2,288,943 | 7/1942 | Eastman | 60/299 |
| 3,302,394 | 2/1967 | Pahnke | 60/274 |
| 3,404,749 | 10/1968 | Miller | 60/274 |
| 3,460,916 | 8/1969 | Aronsohn | 23/288 |
| 3,927,525 | 12/1975 | Jacobs | 60/301 |
| 3,947,545 | 3/1976 | Ishida | 60/299 |
| 3,976,432 | 8/1976 | Schwarz | 60/299 |
| 4,893,465 | 1/1990 | Farrauto | 60/723 |

*Primary Examiner*—Ira S. Lazarus
*Assistant Examiner*—Daniel J. O'Connor
*Attorney, Agent, or Firm*—Kane, Dalsimer, Sullivan, Kurucz, Levy, Eisele and Richard

[57] ABSTRACT

The method of combusting fuel containing exhaust gas comprising the steps of:

a. obtaining a gaseous admixture of air and said exhaust gas, said admixture having an adiabatic flame temperature below about 1400° temperature;

b. contacting at least a portion of said admixture with a catalytic surface and producing reaction products; and c. passing said reaction products to a thermal reaction chamber;

thereby igniting and stabilizing combustion in said thermal reaction chamber at a temperature below 1400° Kelvin.

4 Claims, 1 Drawing Sheet

CATALYTIC METHOD

CROSS-REFERENCE TO RELATED APPLICATION

This application is a Continuation-In-Part application of my U.S. patent application Ser. No. 22,767, filed Feb. 25, 1993, now abandoned, and which was a Continuation of my U.S. application Ser. No. 639,012, filed Jan. 9, 1991 and now abandoned.

BACKGROUND OF THE INVENTION

1. Field of the Invention

This invention relates to improved systems for combustion of fuels and to methods for catalytic promotion of fuel combustion. In one specific aspect the present invention relates to catalytic systems for control of exhaust emissions from internal combustion engines.

2. Brief Description of the Prior Art

Exhaust emissions from small internal combustion engines, such as are used for lawn mowers and small generator sets, are a significant source of atmospheric pollution by hydrocarbons and carbon monoxide. Although automotive emissions are now controlled by use of catalytic converters, such conventional devices are not considered feasible for small engine use because of inherently large size, high cost and system complexity and durability.

The present invention meets the need for reduced emissions by providing a system for the combustion of fuel lean fuel-air mixtures, even those having exceptionally low adiabatic flame temperatures such as admixtures of air with the exhaust gases from small internal combustion engines.

SUMMARY OF THE INVENTION

Definition of Terms

In the present invention the terms "monolith" and "monolith catalyst" refer not only to conventional monolithic structures and catalysts such as employed in conventional catalytic converters but also to any equivalent unitary structure such as an assembly or roll of interlocking sheets or the like.

The terms "microlith" and "microlith catalyst" refer to high open area monolith catalyst elements with flow paths so short that reaction rate per unit length per channel is at least fifty percent higher than for the same diameter channel with a fully developed boundary layer in laminar flow, i.e. a flow path of less than about two mm in length, preferably less than one mm or even less than 0.5 mm and having flow channels with a ratio of channel flow length to channel diameter less than about two to one, but preferably less than one to one and more preferably less than about 0.5 to one. Channel diameter is defined as the diameter of the largest circle which will fit within the given flow channel and is preferably less than one mm or more preferably less than 0.5 mm.

The terms "fuel" and "hydrocarbon" as used in the present invention not only refer to organic compounds, including conventional liquid and gaseous fuels, but also to gas streams containing fuel values in the form of compounds such as carbon monoxide, organic compounds or partial oxidation products of carbon containing compounds.

The Invention

It has now been found that gas phase combustion of prevaporized very lean fuel-air mixtures can be stabilized by use of a catalyst at temperatures as low as 1000 or even below 900 degrees Kelvin, far below not only the minimum flame temperatures of conventional combustion systems but even below the minimum combustion temperatures required for the catalytic combustion method of my earlier systems described in U.S. Pat. No. 3,928,961. The capability to promote rapid gas phase combustion with conversion of fuel at temperatures below 1400° Kelvin is essential to surmount the mass transfer limitations of catalytic converters which result in much larger converter volumes for a given conversion than is required for the catalytic gas phase combustion engine emissions control system of the present invention.

Thus, the present invention makes possible ultra low emission automotive exhaust combustors as much as ten fold smaller in catalyst mass than the much lower conversion catalytic converters presently in use.

In the method of the present invention, a fuel-air mixture is contacted with an ignition source to produce heat and reactive intermediates for continuous stabilization of combustion in a thermal reaction zone at temperatures not only well below a temperature resulting in significant formation of nitrogen oxides from molecular nitrogen and oxygen but even below the minimum temperatures of prior art catalytic combustors. Combustion can be stabilized in the thermal reaction zone even at temperatures as low as 1000° Kelvin or below. Catalytic surfaces have been found to be especially effective for ignition of such fuel-air mixtures. The efficient, rapid thermal combustion which occurs in the presence of a catalyst, even with lean fuel-air mixtures outside the normal flammable limits, is believed to result from the injection of heat and free radicals produced by the catalyst surface reactions at a rate sufficient to counter the quenching of free radicals which otherwise minimize thermal reaction even at combustion temperatures much higher than those feasible in the method of the present invention. The catalyst may be in the form of a monolith, a microlith or even a combustion wall coating, the latter allowing higher maximum operating temperatures than might be tolerated by a catalyst operating at or close to the adiabatic combustion temperature. Advantageously, in many applications the thermal reaction zone is well mixed, especially in reacting engine exhaust gases for emissions control. Plug flow operation is possible provided the thermal zone inlet temperature is above the spontaneous ignition temperature of the given fuel, typically less than about 700° Kelvin for most fuels but around 900° Kelvin for methane and about 750° Kelvin for ethane.

In one embodiment of the present invention, a fuel-air mixture is contacted with an ignition source to produce combustion products, at least a portion of which are mixed with a fuel-air mixture in a well mixed thermal reaction zone.

In a specific embodiment of the present invention which is particularly suited to small gasoline engine exhaust clean-up, engine exhaust gas is mixed with air in sufficient quantity to consume at least a major portion of the combustibles present and passed to a recirculating flow in a thermal reaction zone. Effluent from the thermal zone exits through a monolithic catalyst, preferably a microlith. Pulsation of the exhaust flow draws sufficient reaction products from contact with the catalyst back into the thermal zone to ignite and stabilize gas phase combustion in the thermal zone. Typically, engine exhaust temperature is high enough to achieve thermal combustion light-off within seconds of engine starting, especially with use of low thermal mass microlith igniter catalysts. Hot combustion gases exiting the thermal reaction zone contact the catalyst providing enhanced conversion, particularly at marginal temperature levels for thermal reaction.

Alternatively, the catalyst may be placed at the reactor inlet, as typically would be the case for furnace combustors, or even applied as a coating to the thermal zone walls in a manner such as to contact recirculating gases. Wall coated catalysts are especially effective with fuel-air mixtures at thermal reaction zone inlet temperatures in excess of about 700° Kelvin such as is often the case with exhaust gases from internal combustion engines.

DETAILED DESCRIPTION OF THE INVENTION AND PREFERRED EMBODIMENTS

Figure 1:
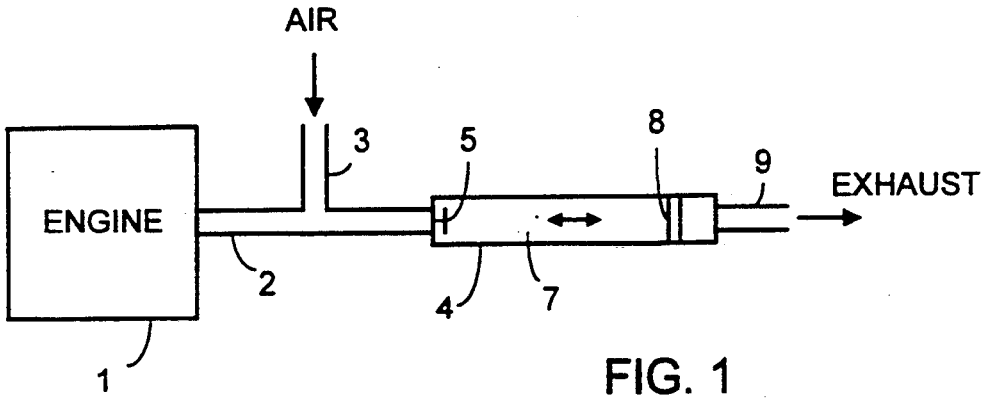
FIG. 1 shows a schematic of a catalytically induced and stabilized thermal reaction system for reduction of pollutants from a single cylinder gasoline engine.

The present invention is further described in connection with the drawings. As shown in FIG. 1, in one preferred embodiment the exhaust from a single cylinder gasoline engine 1 passes through exhaust line 2 into which is injected air through line 3. The exhaust gas and the added air pass from line 2 into vessel 4 where swirler 5 creates strong recirculation in thermal reaction zone 7. Gases exiting vessel 4 pass through catalytic element 8 into vent line 9. Reactions occurring on catalyst 8 ignite and stabilize gas phase combustion in reaction zone 7 resulting in very low emissions of carbonaceous pollutants. Gas phase reaction is stabilized even at temperatures as low as 800° Kelvin.

Figure 2:
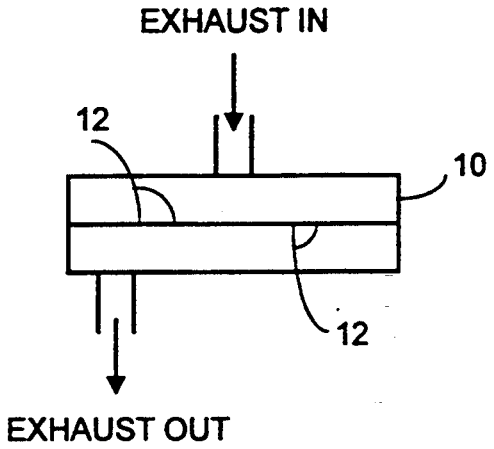
FIG. 2 shows a catalytically stabilized thermal reaction muffler in which thermal reaction is promoted by catalyst coatings.

In FIG. 2, catalytic baffle plate surfaces 12 of exhaust muffler 10 promote gas phase thermal reactions in muffler 10.

EXAMPLE I

Fuel rich exhaust gas from a small single cylinder gasoline powered spark ignition engine was passed into a thermal reactor through a swirler thereby inducing recirculation within the thermal reactor. The gases exiting the thermal reactor passed through a bed comprising ten microlith catalyst elements having a platinum containing coating. Exhaust pulsations resulted in backflow surges through the catalyst back into the thermal reaction zone. Addition of sufficient air to the exhaust gases for combustion of the hydrocarbons and carbon monoxide in the hot 800° Kelvin exhaust gases before the exhaust gases entered the thermal reactor resulted in better than 90 percent destruction of the hydrocarbons present and a carbon monoxide concentration of less than 0.5 percent in the effluent from the thermal reactor entering the catalyst bed. The temperature rise in the thermal reactor was greater than 200° Kelvin.

EXAMPLE II

Using the same system as in Example I, tests were run in the absence of the microlith catalyst bed. Addition of air to the hot exhaust gases yielded essentially no conversion of hydrocarbons or carbon monoxide. Reactor exit temperature was lower than the 800° Kelvin engine exhaust temperature.

EXAMPLE III

In place of the reaction system of Example I, tests were run with the same engine in which a coating of platinum metal catalyst was applied to the internal walls of the engine muffler with the muffler serving as a stirred thermal reactor. As in example I, addition of sufficient air for combustion resulted in stable thermal combustion. With sufficient air for complete combustion of all fuel values, the measured exhaust emissisions as a function of engine load were:

| | Exit Temp. | HC, ppm | CO, % |
|---|---|---|---|
| idle | 800K | 80 | 0.5 |
| ½ load | 913K | 4 | 0.15 |
| full load | 903K | 4 | 0.15 |

EXAMPLE IV

Lean gas phase combustion of Jet-A fuel is stabilized by spraying the fuel into flowing air at a temperature of 750° Kelvin and passing the resulting fuel-air mixture through a platinum activated microlith catalyst. The fuel-air mixture is ignited by contact with the catalyst, passed to a plug flow thermal reactor and reacts to produce carbon dioxide and water with release of heat. The catalyst typically operates at a temperature in the range of about 100° Kelvin or more lower than the adiabatic flame temperature of the inlet fuel-air mixture. Efficient combustion is obtained over range of temperatures as high 2000° Kelvin and as low as 1100° Kelvin, a turndown ratio higher than existing conventional gas turbine combustors and much higher than catalytic combustors. Premixed fuel and air may be added to the thermal reactor downstream of the catalyst to reduce the flow through the catalyst. If the added fuel- air mixture has an adiabatic flame temperature higher than that of the mixture contacting the catalyst, outlet temperatures at full load much higher than 2000° Kelvin can be obtained with operation of the catalyst maintained at a temperature lower than 1200° Kelvin.

What is claimed is:

1. An emissions control system for gas phase combustion of lean admixtures of air and fuel-rich, small internal combustion engine exhaust gases at combustion temperatures below 1400° Kelvin, which comprises;

a. an exhaust pipe connected to a small, internal combustion engine, for carrying the exhaust from the engine;

b. pipe means for injecting air into the carried exhaust;

c. a gas phase combustion chamber connected to the exhaust pipe to receive the carried exhaust and injected air, and having a chamber inlet and a chamber outlet, said chamber having a gaseous pathway within the chamber between the inlet and the outlet;

d. catalyst surface means disposed on internal surfaces of said combustion chamber for igniting and stabilizing gas phase combustion at temperatures be below 1400° Kelvin; and e. conduit means for passing the admixture of air and engine exhaust gases into said inlet and into contact with said catalyst means for gas phase combustion at a temperature below 1400° Kelvin.

2. The system of claim 1 wherein said catalyst means comprises platinum.

3. The system of claim 1 wherein said catalyst means comprises palladium.

4. The method of combusting fuel containing exhaust gas comprising the steps of:

a. obtaining a gaseous admixture of air and said exhaust gas, said admixture having an adiabatic flame temperature below about 1400° Kelvin;

b. contacting at least a portion of said admixture with a catalytic surface, producing heat and reactive intermediates for continuous stabilization of combustion in a thermal reaction zone at temperatures below a temperature resulting in significant formation of nitrogen oxides from molecular nitrogen and oxygen; and c. passing said reaction products to the thermal reaction chamber;

thereby igniting and stabilizing combustion in said thermal reaction chamber at a temperature below 1400° Kelvin.

* * * * *

UNITED STATES PATENT AND TRADEMARK OFFICE

CERTIFICATE OF CORRECTION

PATENT NO. : 5,437,152

DATED : August 1, 1995

INVENTOR(S) : William C. Pfefferle

It is certified that error appears in the above-indentified patent and that said Letters Patent is hereby corrected as shown below:

In every instance where the word "microlith" appears in this patent, it should read -- Microlith ™ -- .

Signed and Sealed this Ninth Day of July, 1996

*Attest:*

*Attesting Officer*

BRUCE LEHMAN

*Commissioner of Patents and Trademarks*